US008046968B2

(12) United States Patent
Kellner

(10) Patent No.: US 8,046,968 B2
(45) Date of Patent: Nov. 1, 2011

(54) FLOOR MADE FROM INDIVIDUAL ELEMENTS

(76) Inventor: Peter Kellner, Philippsthal (DE)

( * ) Notice: Subject to any disclaimer, the term of this patent is extended or adjusted under 35 U.S.C. 154(b) by 89 days.

(21) Appl. No.: 12/460,550

(22) Filed: Jul. 20, 2009

(65) Prior Publication Data

US 2009/0313915 A1 Dec. 24, 2009

Related U.S. Application Data

(63) Continuation of application No. 10/473,026, filed as application No. PCT/DE02/00555 on Feb. 15, 2002, now abandoned.

(30) Foreign Application Priority Data

Mar. 26, 2001 (DE) ..... 101 14 924

(51) Int. Cl.
*E04B 5/02* (2006.01)

(52) U.S. Cl. ..... 52/586.2; 52/586.1; 52/591.2; 52/403.1

(58) Field of Classification Search ..... 52/586.1, 52/586.2, 403.1, 591.1, 591.2, 396.05, 396.06, 52/396.1, 612, 309.8, 309.9, 796.1, 177, 52/105, 396.08, 393, 302.4, 302.3
See application file for complete search history.

(56) References Cited

U.S. PATENT DOCUMENTS

| | | | | |
|---|---|---|---|---|
| 3,831,339 | A * | 8/1974 | Piralli | 52/584.1 |
| 4,461,131 | A * | 7/1984 | Pressell | 52/395 |
| 4,730,428 | A * | 3/1988 | Head et al. | 52/309.11 |
| 4,855,177 | A | 8/1989 | Leis | |
| 5,875,599 | A * | 3/1999 | McGrath et al. | 52/586.2 |
| 5,896,717 | A * | 4/1999 | Gill | 52/586.2 |
| 6,363,677 | B1 * | 4/2002 | Chen et al. | 52/586.1 |
| 6,792,727 | B2 * | 9/2004 | Krieger | 52/245 |
| 7,093,398 | B2 * | 8/2006 | Spransy et al. | 52/586.2 |
| 7,260,919 | B1 * | 8/2007 | Spransy et al. | 52/586.1 |
| 7,665,264 | B1 * | 2/2010 | Wolfe | 52/586.2 |
| 7,774,991 | B2 * | 8/2010 | Fletcher et al. | 52/71 |

FOREIGN PATENT DOCUMENTS

| | | |
|---|---|---|
| CH | 446 680 | 11/1967 |
| DE | 1 715 436 | 1/1956 |
| DE | 1 769 595 | 7/1958 |
| DE | 25 08 628 | 9/1976 |
| DE | 33 04 992 | 8/1984 |
| DE | 38 01 603 A | 7/1989 |
| DE | 297 12 668 | 9/1998 |
| EP | 0 972 893 | 1/2000 |
| FR | 995.626 | 6/1955 |
| FR | 1 524 707 A | 5/1968 |
| WO | WO-00 67999 | 11/2000 |

* cited by examiner

*Primary Examiner* — Phi Dieu Tran A
(74) *Attorney, Agent, or Firm* — Jordan and Hamburg LLP

(57) ABSTRACT

A multi-layer floor panel unit, which can be assembled with a plurality of similar units to form a floor which is capable of repeatedly being disassembled and reassembled at different times and/or in different locations, includes a pressure-resistant and wear-resistant upper layer; a pressure-resistant lower layer, attached to the upper layer, and having grooves at vertical edges of the lower layer; and connecting strips in the grooves, for connecting adjacent multi-layer floor panel units, the connecting strips having horizontal legs with thickened portions thereon, the thickened portions being for clamping the connecting strips in the grooves.

31 Claims, 7 Drawing Sheets

FLOOR MADE FROM INDIVIDUAL ELEMENTS

BACKGROUND OF THE INVENTION

The invention relates to a floor consisting of individual two-dimensional elements.

The invention is intended, in particular, for temporarily installed floors, which can be removed following installation and use, and reused again. Such floors are required, for example, for use in exhibitions. It was previously not possible to configure level and quality floor surfaces with a high load-carrying capability, especially when thin, and therefore light natural stone panels, are used.

In the state of the art, floors comprising textile coverings, which can be removed following use, are known. In this connection, the covering is removable from the floor without leaving a residue and without damaging the floor covering.

According to DE 36 00 807 C2, a method is disclosed for this purpose, for which a plastic layer is disposed on both sides of a backing material, at least one side of which is glueable, impermeable to the adhesive and resistant to water.

For use under high loads and for external use, it is known that stone, concrete or ceramic elements may be laid in mortar or on corner supports. According to DE 197 37 097 C2, a system is known, for which panels are used, and which are laid individually next to one another, or with the help of connecting plates on which the floor covering is applied.

When used in the usual manner for achieving the strength required, natural stone panels are relatively thick and heavy, and therefore cumbersome to transport. For this reason, they are not generally suitable for repeated use. Because of the danger of breakage, thin natural stone panels, which are therefore easily transported, must be glued onto a level substrate or laid in a bed of mortar, and therefore also, are also not suitable for temporary and repeated use.

It is, therefore, an object of the invention, to provide a floor configuration of high strength, comprised of individual elements which are light and easily transported, as well as easily removable, and which can be used repeatedly.

It is a further object to indicate a floor panel unit with a high load-carrying capability of individual floor panels being lightweight and easily transportable and easy to assemble and disassemble, whereas the necessary construction elements are easily removable and re-usable at different times. Moreover, the floor panel unit should be pleasantly passable on foot and allow a re-use in multiple applications.

SUMMARY OF THE INVENTION

Pursuant to the invention, these objectives are accomplished by use of individual floor panels of multi-layer construction, each comprising a pressure-resistant and wear-resistant upper layer and a pressure-resistant lower layer attached to said upper layer. The lower layer includes horizontal grooves at vertical edges thereof in which fastening rails are fixable. The fastening rails include horizontal reception grooves each which includes undercuts at upper and lower inner surfaces thereof. Connecting strips, each include horizontal legs which are formed elastically by provision of a horizontal slot extending between a pair of leg segments which define each of said horizontal legs, the leg segments including thickened portions thereon which are vertically extended from a remainder of said leg segments in opposed directions. The thickened portions are configured to engage the undercuts at the upper and lower inner surfaces of the horizontal reception grooves of the fastening rails for providing a positive, but detachable connection with adjacent ones of the individual floor panels, wherein the adjacent ones of the individual floor panels are thereby connectable together by a shared one of the connecting strips.

Due to the multilayer construction of the individual panels, with, in each case, a thin panel on the upper side and, below this, a pressure-resistant light material layer, which preferably consists of a foamed material, a light floor element with a high quality surface and sufficient strength is realized.

Due the arrangement of the peripheral grooves at the edges of the layer of light material and of connecting strips in the grooves between adjacently placed multilayer panels, the securing of the floor elements against shifting in the joint direction, as well as avoidance of offsets between adjacently laid multilayer panels, is accomplished in an easy manner. Because thin, two-dimensional sheathing of high strength and high modulus of elasticity is glued between the upper panel and the light material layer, a very high strength of the floor elements is realized, even when very thin panels and, therefore, very light floor elements are used. Such a high strength of the floor elements ensures a sufficient safety against fracture, even in the case of localized stresses which occur, for example, when shelves or cabinets, which are supported at points, are arranged. Moreover, the floor elements do not need to be laid in a bed of mortar or glued to a substrate.

In accordance with another embodiment, the floor panel unit according to the invention comprises a number of two-dimensional multilayer floor panels, each including a thin pressure-resistant and wear-resistant upper layer and a pressure-resistant support member. Pursuant to the further embodiment of the invention, each of the directly adjacent disposed floor panels is connected with each other in a corner region and/or in an outer edge area with a two-dimensional connecting element, which is located below the floor panels. The two-dimensional connecting element features vertically disposed outer legs engaging with material gaps, which are located in an undersurface of the support members and which correspond to the outer legs.

Due to the construction of individual floor panels with connecting elements, and outer legs being located on the latter and being preferably symmetrical to each other, a stable arrangement of floor panels with a constant distance between each other is easily accomplished avoiding offsets between floor panels. Furthermore, such connection being preferably force-closed and/or form-closed enables an easy assembly and, primarily, an easy disassembly of the floor panel unit, as the floor panels can be removed separately. As a result, there is the advantage of exchangeability of individual floor panels, for instance because of damages or a desired change of design.

Moreover, lightweight floor panels can be produced with high-grade floor surfaces and a high load-carrying capability. This is accomplished by the multilayer construction of the individual floor panels with at least one thin upper layer on the upper surface and a preferably glued pressure-resistant support member being disposed beneath and being particularly formed of lightweight material.

In a preferred version of the embodiment of the invention, the outer legs are radial, right-angled and/or parallel to each other, such that another increase of stability of the connection with support members is achieved by using multiple parallel disposed legs.

Additionally, according to a further embodiment of the invention, material grooves are each placed in the undersurface of the support members, whereas a material surface, being enclosed by these material grooves, corresponds with gaps being placed in an area of the connecting element.

Besides another increase of securement against shifting of the connecting elements on the support members, and besides the stability of the connection, a flush arrangement of the connecting elements at the undersurface of the floor panels or, rather at the support members, is achieved, on the one hand avoiding an additional elevation of the floor panel unit and, on the other hand enabling a maximum supporting surface, and thus an increased stability of the entire floor panel unit.

A preferred embodiment of the invention provides that the outer legs are compressible into the material gaps of the support members and/or provides that material surfaces of the support members, being enclosed by material grooves, are compressible into the gaps of the connecting element. The arising press fit enables an arrangement and connection of the floor panels being free from play.

A further intention provides that primarily vertical and right-angled joint fillets are fastened into a middle area of the connecting element, enabling a constant and definable lateral dimension of a joint between individual floor panels.

According to a further embodiment of the invention, a height of the joint fillets is smaller or equal to the thickness of the floor panels, so that these joint fillets do not tower over the floor panels.

Alternatively, the height of the joint fillets is smaller or equal to a thickness of the support member, if the joint fillets can be disposed in recesses, which correspond to the joint fillets and which are placed in vertical lateral faces of the support members. Thus, a jointless laying of the floor panels is advantageously possible.

Furthermore, jointless laying or rather arrangement of floor panels is achievable thereby that the upper layer is wider and/or longer than the related support member, whereas the upper layer towers over the vertical lateral face of the support member so that the joint fillets are covered by the upper layer.

It is particularly advantageous that the undersurface of the support members additionally features burling-like disposed material high spots, which also enables in a functional way a laying of the floor panel unit on undefined ground, which is especially uneven, as material high spots adjust unevenness.

Moreover, preferably channel-like grooves are placed into the undersurface and/or upper surface of the support members. One the one hand, these grooves aim to conduct condensation dew and/or humidity, on the other hand, conduits of a floor heating are capable of being integrated especially into channel-like grooves placed into the upper surface of the support members, or rather, the channel-like grooves are usable as conduits. Furthermore, especially channel-like grooves being placed in the undersurface are suitable for housing power cords, so that these power cords can be laid outside a field vision and do not negatively influence the outer impression of the floor panel unit.

Additionally, according to a particular preferred embodiment of the invention, guide elements are disposed at the floor panel and/or at the connecting element, via which joint strips can be fixed between the floor panels. This is a simple way to fasten joint strips, which can be advantageously detached, so that joint strips can be simply assembled, disassembled and replaced.

The invention is explained in greater detail in the following with reference to examples shown in the accompanying drawings. In all figures, corresponding parts have the same reference designators.

DETAILED DESCRIPTION OF THE INVENTION

Figure 1:
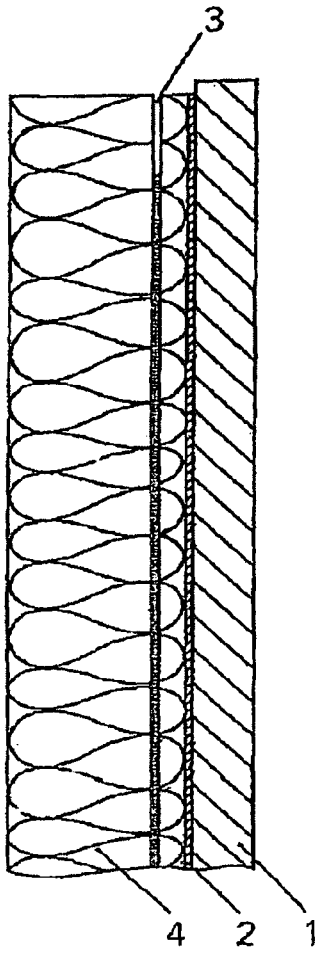
FIG. 1 is a cross-sectional view of a multilayer panel in accordance with an embodiment of the invention.

The section through an inventive, multilayer panel, is illustrated in FIG. 1, and shows a thin panel 1 of natural strength. A carbon fiber-reinforced plastic fabric of small thickness is glued two-dimensionally to an underside of the panel 1 by means of an epoxide resin, as a two dimensional sheathing 2. In addition to natural stone, the thin panel 1 may be comprised of glass, wood, or metal. In comparison with the natural stone panel, etc., the carbon fiber-reinforced plastic fabric has a relatively high modulus of elasticity. The tensile strength and the compression strength of the carbon fiber-reinforced plastic fabric are clearly greater than the compression strength of the natural stone. Beneath the carbon fiber-reinforced plastic fabric, a pressure-resistant foam layer 4, which comprises an extruded and hydrophobized Styrofoam, is glued two-dimensionally. Due to the multilayer construction shown, a multilayer panel of low weight and high bending strength is achieved. In the case of an appropriate construction, the sheathing 2 is disposed within the layer 4 of light material. The sheathing elements advantageously can also be introduced, owing to the fact that the slots for accommodating strip-shaped sheathing 2 are incorporated in the layer 4 of lightweight material. For example, the slots can be incorporated in pre-manufactured lightweight panels before the latter are combined with the thin panel 1 and the strip-shaped sheathing 4 is subsequently glued into these slots.

Peripheral grooves 3, which accommodate the connecting strips 9, are disposed at all four edges of the layer 4 of light material of the square floor panel. The panels may have edge lengths of 200 to 2200 mm. Preferably, squares with a length of 300 to 500 mm and a thickness 10 to 20 mm are used.

Figure 2:
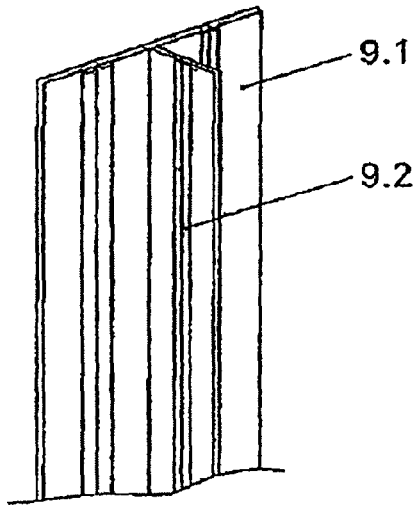
FIG. 2 is a perspective view of a connecting strip in accordance with an embodiment of the invention.

Such a connecting strip 9 is shown in FIG. 2. The connecting strip 9 has at least two horizontal legs 9.1. The embodiment, shown in FIG. 2, is similar to a T-shaped profile and has two horizontal legs 9.1 and an additional vertical leg 9.2. The thickness of the horizontal legs 9.1 is slightly less than the width grooves 3; in the longitudinal direction of the profile, profilings, in which the horizontal legs 9.1 are clamped securely in the grooves 3 and which thus serve to connect adjacently disposed multilayer panels, are disposed at the horizontal legs 9.1. To facilitate the assembly, it is advisably to provide the ends of the horizontal legs 9.1 with a conically constructed chamfered edge. The vertical legs 9.2 maintain a defined vertical joint width between the multilayer panels.

Figure 3:
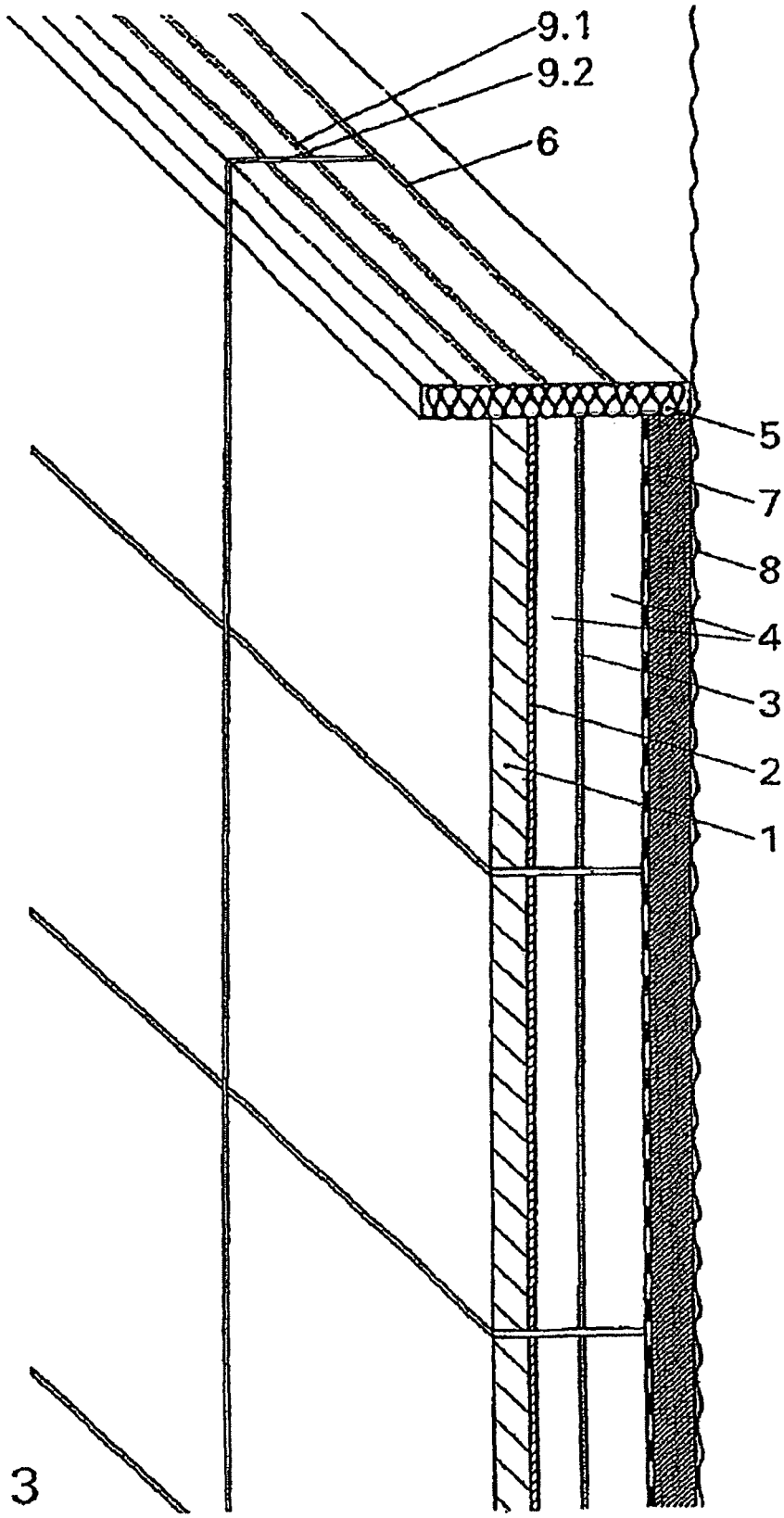
FIG. 3 is a cross-sectional perspective view of a total arrangement of a floor.

FIG. 3 shows an asymmetrically represented section of an overall arrangement of a floor with several multilayer panels, which are connected in each case by connecting strips 9. The multilayer panels are laid on a level substrate; the substrate consists of a lower sheet 8, over which a rapidly setting jointless floor 7 is cast. An upper sheet 6 is disposed over the jointless floor 7. The floor is bounded at the sides by an L-shaped metal, angled profile 5, the horizontal leg of which is covered with the jointless floor 7. The angle profile 5 is fixed in the substrate by this covering. At the side facing the floor, the vertical leg of the angle profile 5 is provided with a compressible sealing tape, which prevents the mortar emerging from the frame. The mutual connection of the connecting strips 9, which are disposed in the two joint directions at the crossing points of joints between the multilayer panels, is not shown in the Figure.

FIG. 4 explains a detail of a connecting site, for which there are additional fastening rails 10, which have a groove engaged by the horizontal legs 9.1 of the connecting strips 9, in the side surfaces of the layer 4 of light material. Advantageously, the horizontal legs 9.1 are formed elastically by a slot and are provided at the end with thickenings, which engage corresponding undercuts at the inner surfaces of the fastening rails and thus make possible a positive, but detachable connection and, with that, a secure and gap-free arrangement of adjacent panels.

Figure 4A:
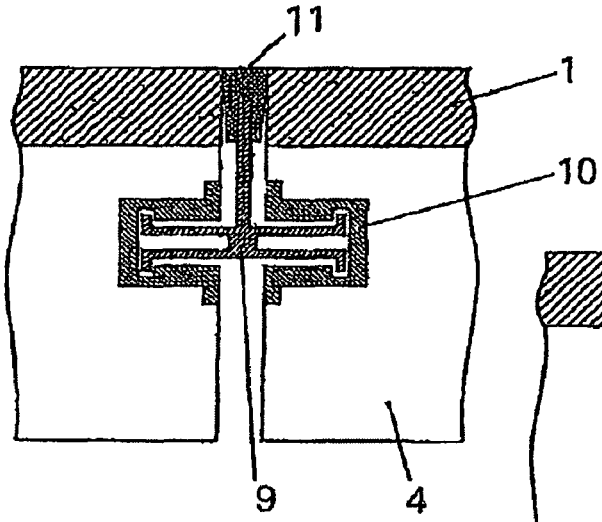
FIG. 4 shows a detail of the connecting site.
Figure 4C:
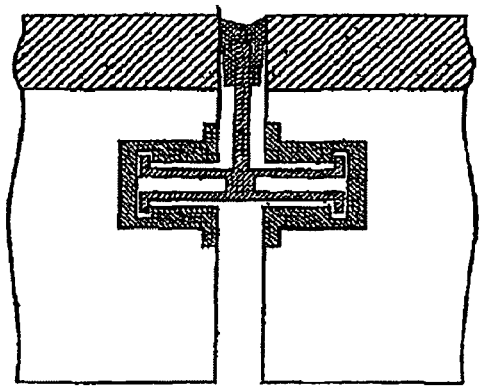
Figure 4B:
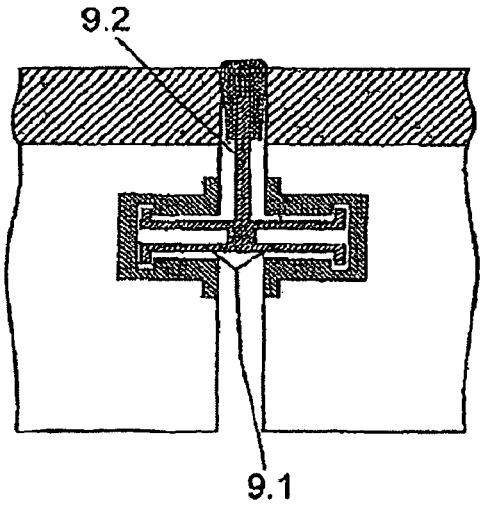
Figure 4D:
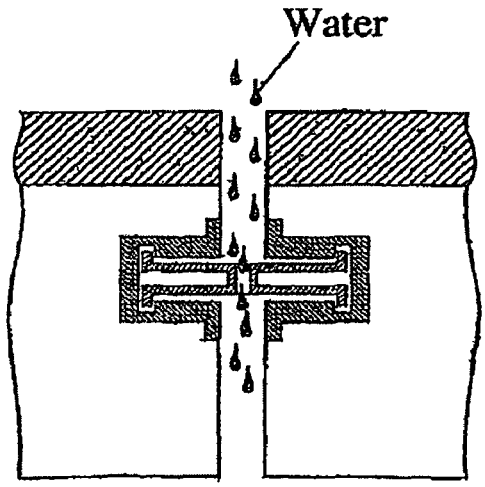

At the same time, it is also possible that the vertical legs 9.2 are provided at their upper side with colored edge strips 11 of an elastic plastic, which fulfill decorative tasks, as well as improve the sealing. Aside from a flat shape, shown in FIG. 4, the surface of the edge strip 11 can also have a raised shape, as shown in FIG. 4*b*, or be constructed as a fillet, as shown in FIG. 4*c*. Furthermore, it is possible to use the versions of the connecting strip 9 without a vertical leg 9.2. These embodiments, suitable especially for use for exterior patio panels, are shown in FIG. 4*d*. The connecting strip consists here only of the two horizontal legs 9.1, which are provided with openings. By these means, it becomes possible to discharge water from the surface of the panels, which drains through the gap between adjacent panels and can be discharged through the connecting strip 9.

Figure 5:
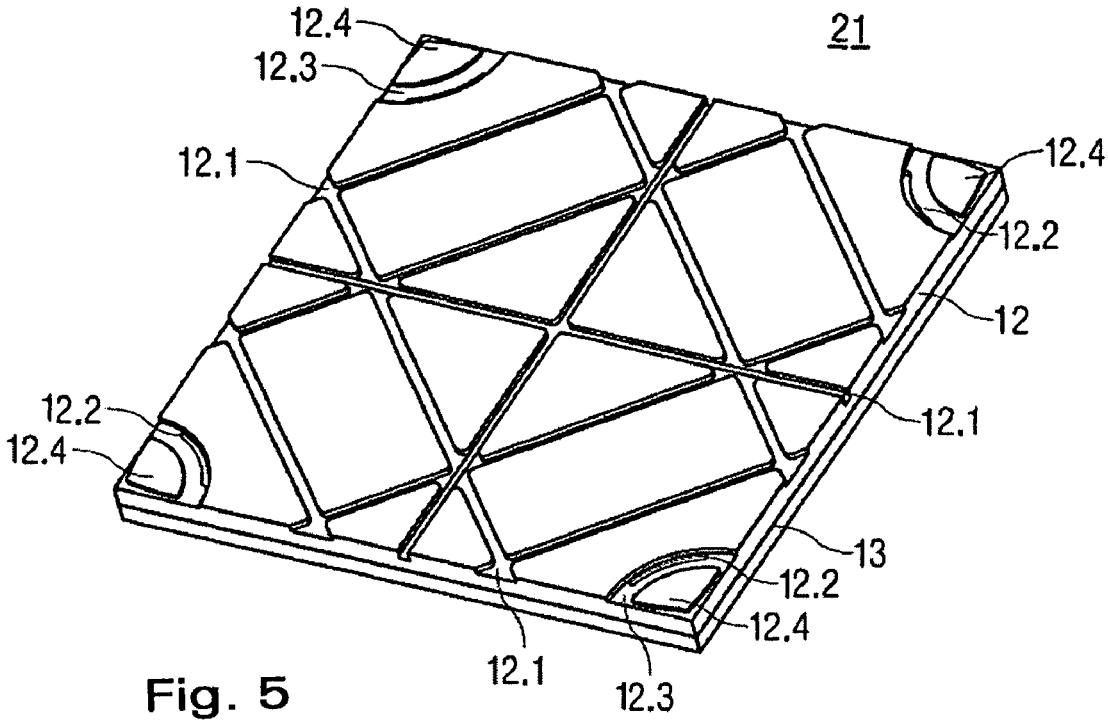
FIG. 5 schematically shows an underside perspective view of a two-dimensional multilayer floor panel according to another embodiment.

A two-dimensional multilayer floor panel 21 according to another embodiment of the invention is illustrated in FIG. 5, viewed in perspective from an undersurface thereof, comprises a support member 12 and an upper layer 13. The support member 12 is preferably made of a pressure-resistant and contemporaneously lightweight material, which is particularly a matter of a form of foam, as for example, expanded polypropylene, polystyrene or other suitable lightweight materials with a high load-carrying capability, as e.g., wooden polypropylene or glass-fiber reinforced plastic.

Upper layer 13 is made of natural stone, although upper layer 13 can also be made of glass, wood, metal, plastic or another stable material. Therefore, a combination of different materials is possible. Upper layer 13 and support member 12 are two-dimensionally glued together, whereas preferably an epoxy resin or other glues are usable as glue.

A joint-gentle walk and therefore a high comfort while walking can be realized because of the multilayer construction of the floor panel.

In accordance with a further development of the invention, which is not described in greater detail, an additional intermediate layer, made of, for example, carbon fiber reinforced plastic, is disposed between support member 12 and upper layer 13. Compared to the natural stone panel, this intermediate layer features a high modulus of elasticity. Tensile strength and compression strength of the intermediate layer is considerably higher than the compression strength of the natural stone. Due to such a multilayer construction, a high tensile bending strength is achieved, if the weight of the multilayer element is light.

The intermediate layer can continuatively be also made of a ceramic layer. Ceramic material advantageously features a very high load-carrying capability so that floor panel 21 features a high load-carrying capability and stability, even if a very thin upper layer 13 is used. Because of this very thin construction of upper layer 13, a strongly reduced total weight of floor panel 21 is achieved, particularly if the used material is natural stone.

Air humidity arising by the ground or water entering from upper layer 1' is guided in channel-like crossing grooves 12.1 being placed in the undersurface of support member 12 to the edge of the floor surface.

In a further embodiment of the invention, which is not described in greater detail, channel-like grooves 12.1 are also placed in the upper surface of support member 12, in which condensation dew arising at the undersurface of upper layer 13 can advantageously be evaporated and discharged. Furthermore, grooves being placed in the upper surface of support member 12 are suitable for guiding a medium, e.g. warm air, so that a floor heating is realizable. Channel-like grooves 12.1 can lie on top of each other in a parallel or congruent way regarding their upper surface and undersurface or they can be placed offset.

Figure 6:
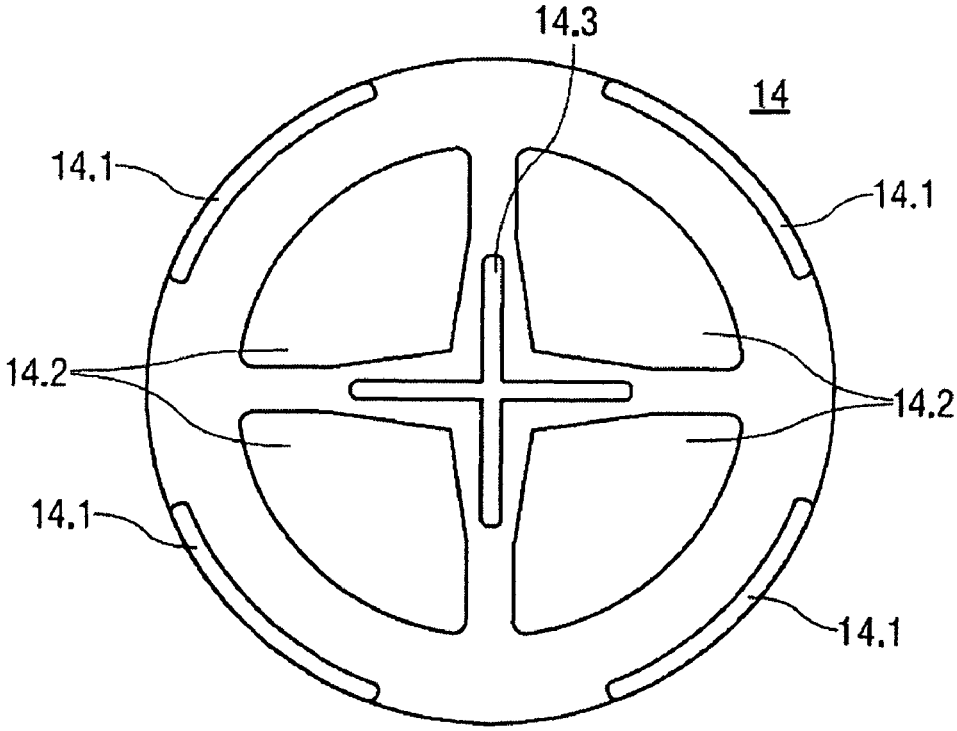
FIG. 6 schematically shows a connecting element in a top view.
Figure 7:
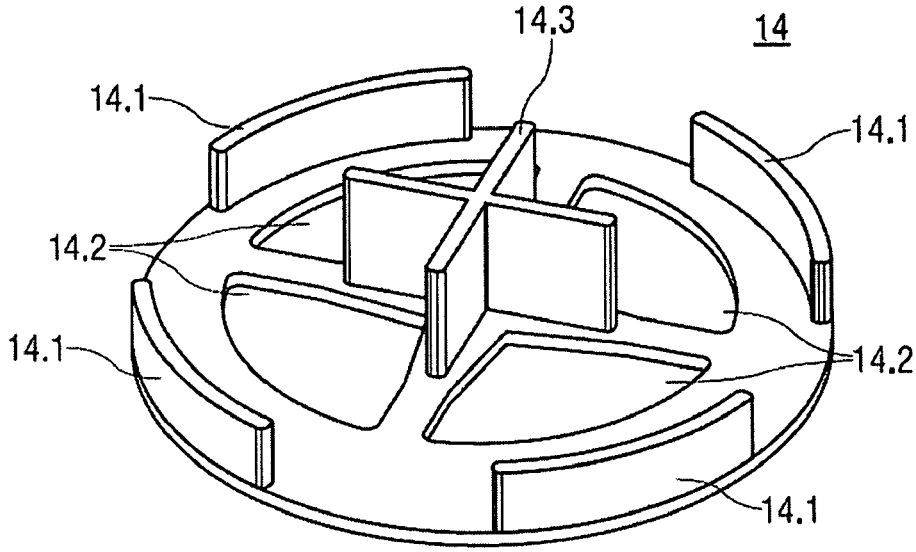
FIG. 7 schematically shows the connecting element according to FIG. 6 in a perspective view.

According to the invention, a two-dimensional connecting element 14 described in greater detail in FIGS. 6 and 7 is intended, in order to connect multiple floor panels of this kind. This connecting element is disposed beneath floor panels 21, that is to say between floor panels 21 and ground, and it is round or rather circular in the example of the invention. Connecting element 14 is for instance made of plastic.

Thereby, connecting elements 14 are connected to the undersurface of support member 12 in a force-closed and/or form-closed way, whereas every connecting element 14 consists of multiple vertically disposed outer legs 14.1, which are radial and symmetric to each other. In the shown example of the invention there are particularly four outer legs 14.1. Thereby, one outer leg 14.1 each is disposed in a quarter circle.

Moreover, material gaps 12.2 are placed at the angles of the undersurface of support members 12, which correspond to the outer legs 14.1 of the connecting element 14. Outer legs 14.1 engage with these material gaps 12.2.

In order to achieve another increase of stability of the connection between support members 12 and connecting elements 14, material grooves 12.3 are placed each in support members 12, whereas a material surface 12.4 being enclosed by material grooves 12.3 corresponds with gaps 14.2 being placed in an area of connecting element 14. Thereby, gaps 14.2 being placed in connecting elements 14 are disposed with each an outer leg 14.1 in a quarter circle. Furthermore, material grooves 12.3 and gaps 14.2 corresponding to these material grooves 12.3 advantageously result in the fact that the undersurfaces of support members 12 and the connecting elements 14 form a layer so that connecting elements 14 do not tower over the undersurface of connecting elements 14.

Figure 8:
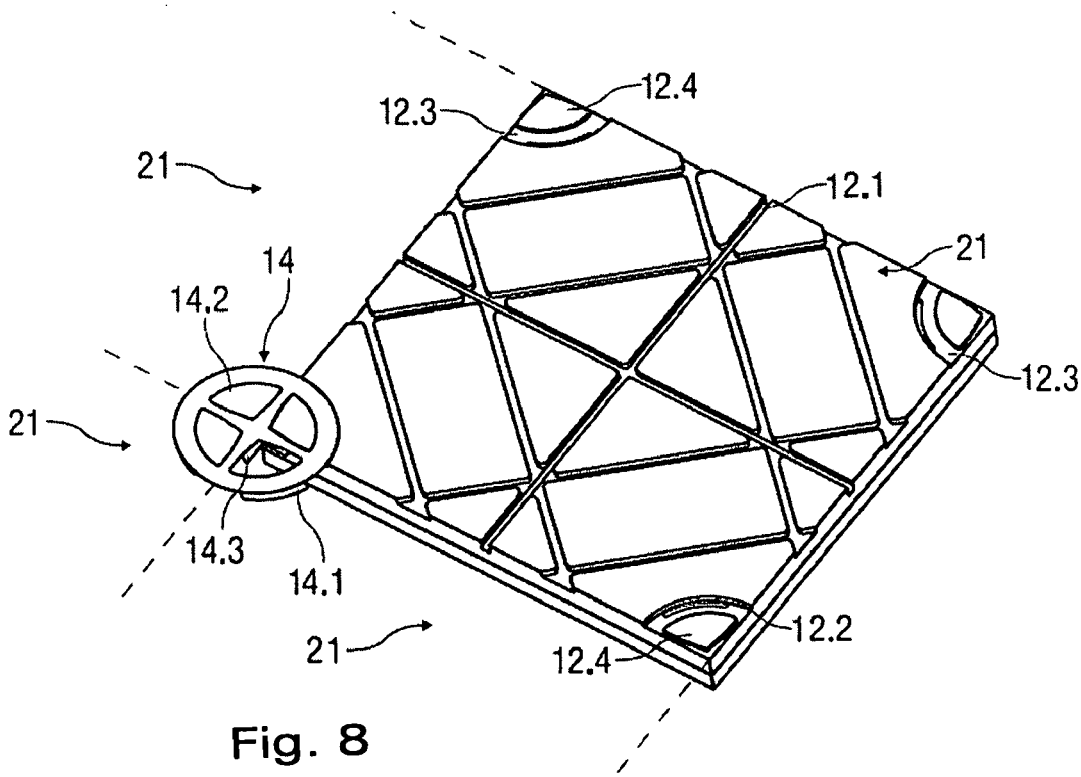
FIG. 8 schematically shows the floor panel according to FIG. 5 with the connecting element, according to FIG. 6, placed at the floor panel.

Therefore, as shown in FIG. 8, four floor panels 21 each are connectable with each other using a connecting element 14, whereas each angle of floor panel 21 corresponds with a quarter circle of connecting element 14. Thereby, floor panels 21 are in such a manner connectable with each other that a total connection of floor panels 21 is characterized by continuous going joints and/or abutting edges.

As the floor panel unit consists of multiple floor panels 21, the total floor panel unit is frost-resisting because a dilatation of floor panels 21 is possible, if freezing water enters from a position beneath or between floor panels 21.

According to a further embodiment of the invention, which is not described in greater detail, material gaps 12.2 and material grooves 12.3 are also disposed between relative angles of connecting element 12, whereas two quarter circles each, that is to say one semicircle, is formed, in order to achieve also an offset arrangement of floor panels 21 and hence an uncontinuous going of joints and/or abutting edges.

In accordance with an advantageous further embodiment of the invention, connecting elements 14, material gaps 12.2 corresponding to connecting elements 14 and being placed in support members 14, and material grooves 12.3 are in such a manner constructed that connecting elements 14 are compressible into support members 12 so that a connection being free from play and stable arises.

Additionally, connecting elements 14 feature vertical and right-angled joint fillets 14.3 in a middle area. A lateral dimension between floor panels 21 can be preset with these joint fillets 14.3. These joint fillets 14.3 are advantageously in such a manner disposed and constructed that a press fit arises between these joint fillets 14.3 and support members 14 so that joint fillets 14.3 contribute to another increase of stability of the connection of floor panels 21.

In the shown example of the invention, a height of the joint fillets 14.3 is smaller than a thickness of support members 12. Therefore, it is possible to achieve a jointless arrangement of floor panels 21 without distance to the floor panels, that is to say a directly adjacent arrangement of floor panels 21 is possible, even if joint fillets 14.3 are used. For this purpose it is possible to place recesses in vertical lateral faces of support members 12, which correspond to joint fillets 14.3, depending on the case of practice, in a manner not described in greater detail, so that upper layers 13 of individual floor panels 21 can be placed directly and without distance to each other.

Alternatively, it is also possible that, depending on the case of practice, upper layers 13 are wider and/or longer than the each related support member 12, so that upper layers 13 can be disposed in a way that they tower over vertical lateral faces of support member 12.

Several visual effects can be achieved by placing recesses corresponding with joint fillets 14.3 into only two vertical opposing lateral faces of support members 12 or just by using a longer or wider construction of upper layer 13. So, it is possible that joints go for instance just to one spatial direction, for example crossways, whereas floor panels 1 are jointlessly disposed in longitudinal direction.

In another embodiment of the invention, which is not described in greater detail, guide elements are disposed at floor panels 21 and/or at connecting elements 14. Joint strips can be fastened between floor panels 1 with these guide elements. Thereby, guide elements are constructed as for instance a U-shaped or V-shaped profile, in which joint strips corresponding to this profile engage or preferably lock in place. Joint strips are preferably made of plastic and can be produced in several colors. Consequently, several visual effects can be simply achieved, again. Moreover, joint strips are easy to assemble and disassemble so that they are easily and quickly removable.

Figure 9:
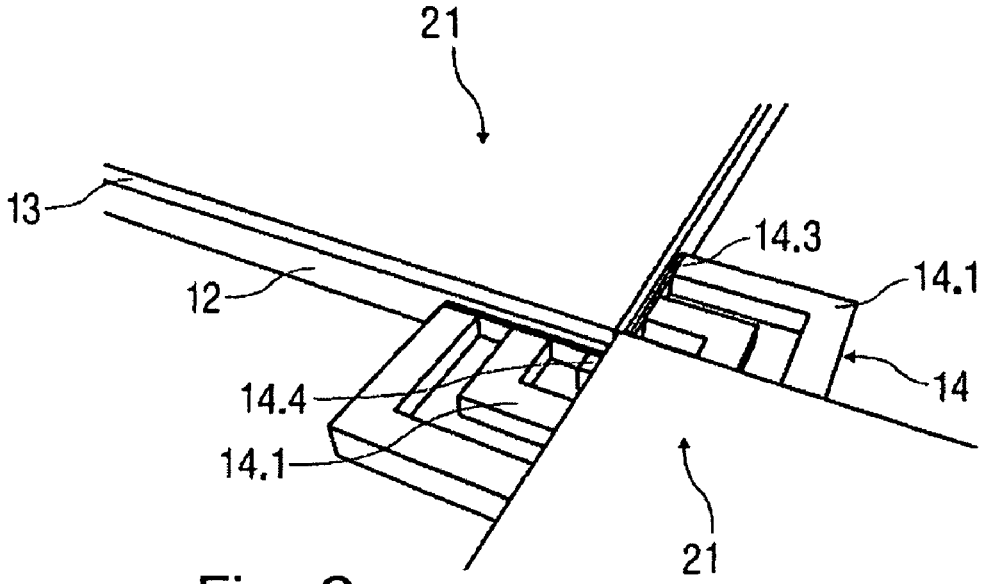
FIG. 9 schematically shows two floor panels being connected to three fillets via a square connecting element.

FIG. 9 shows two floor panels 21 being connected to each other by a connecting element 14 featuring a square area and legs 14.1 being parallel to each other in every quarter circle, whereas directly adjacent and right-angled legs 14.1 build each a continuous frame-like leg.

Regarding the middle of connecting element 12, on which a cuboid-formed leg 14.4 is disposed, four vertical disposed joint fillets 14.3 are constructed, so that a defined distance between floor panels 21 is realizable.

Support members 12 of floor panels 21 consist of material gaps corresponding to legs 14.1 and cuboid-formed legs 14.4, not described in greater detail, whereas material gaps, legs 14.1 and joint fillets 14.3 are preferably in such a manner constructed that connecting elements 14 are compressible into support members 12 of floor panels 21.

Figure 10:
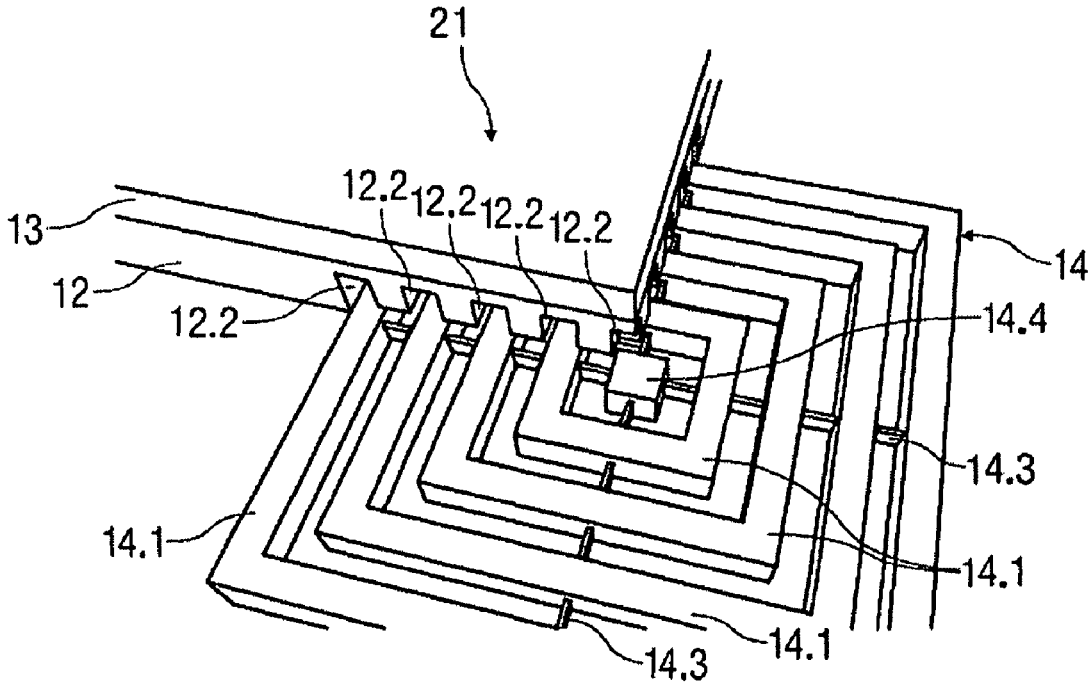
FIG. 10 schematically shows a floor panel and a square connecting element with five fillets.

A floor panel 21 and a square connecting element 14 are illustrated in FIG. 10, whereas this connecting element 14 consists of four parallel legs 14.1 each in every quarter circle, on the contrary to the arrangement shown in FIG. 9.

Regarding a construction of floor panels 21 and connecting elements 14 according to FIGS. 9 and 10, connecting elements 14 are preferably made of the same material as support members 12, that is to say they are for instance made of a form of foam.

Figure 11:
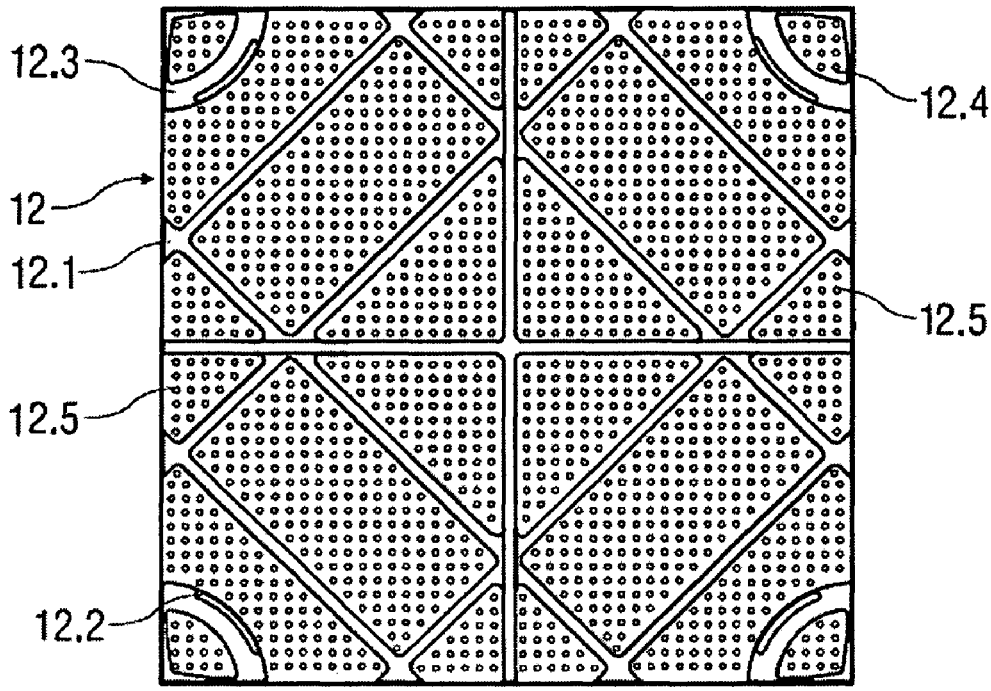
FIG. 11 schematically shows a top view of an undersurface of a floor panel, featuring burling-like disposed material high spots.
Figure 12:
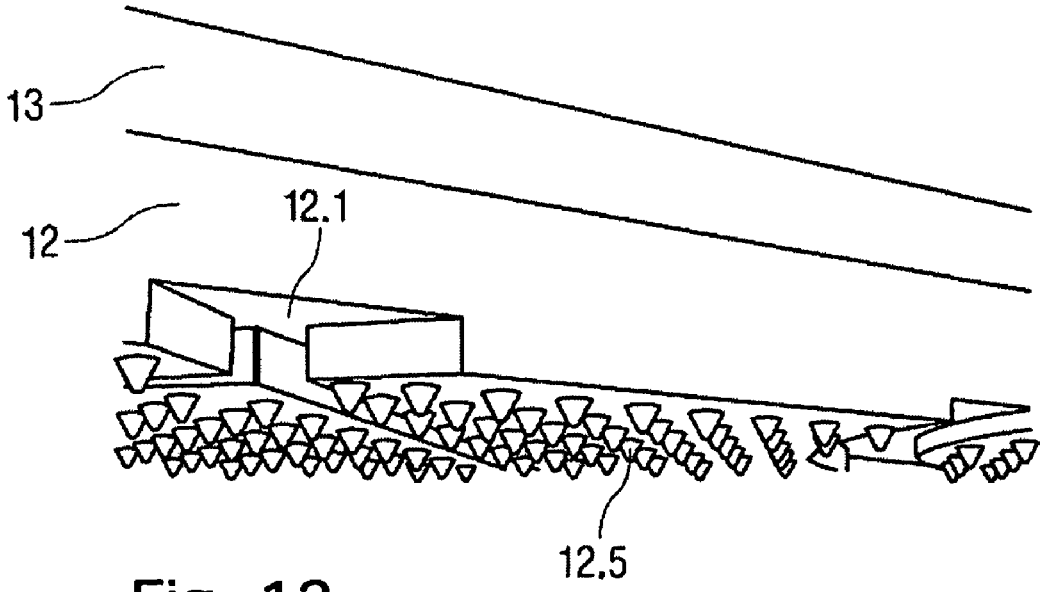
FIG. 12 schematically shows a perspective view of the undersurface according to FIG. 11.

A particular profitable embodiment of the invention is shown in FIGS. 11 and 12, whereby an undersurface of support member 12 features burling-like disposed material high spots 12.5. These material high spots 12.5 are regularly disposed and constructed as a circular cone. However, alternatively also an irregular arrangement and other shapes are possible, as for example a shape of a pyramid.

In a particular profitable manner, material high spots 12.5 result in the fact that floor panels 21 can also be laid on uneven ground or other surfaces, as floor panels 21 adjust unevenness. For this purpose, material high spots 12.5 are not resiliently constructed so that these material high spots 12.5 irreversibly change their shapes, if they were laid on uneven ground, in such a manner that unevenness is compensable. For this purpose, particularly the use of material of polystyrene is suitable. In addition, a further improved sub ventilation of floor panels 21 and an improved discharge of humidity are ensured because of material high spots 12.5.

What is claimed is:

1. A floor, comprising:

individual floor panels of multi-layer construction each comprising a pressure-resistant and wear-resistant upper layer and a pressure-resistant lower layer attachhed to said upper layer, said lower layer including horizontal grooves at vertical edges thereof;

fastening rails being fixed in said horizontal grooves, said fastening rails including horizontal reception grooves each which includes undercuts at upper and lower inner surfaces thereof;

connecting strips each including horizontal legs which are formed elastically by provision of a horizontal slot extending between a pair of leg segments which define each of said horizontal legs, said leg segments including thickened portions thereon which are vertically extended from a remainder of said leg segments in opposed directions, said thickened portions being configured to engage said undercuts at said upper and lower inner surfaces of the horizontal reception grooves of said fastening rails for providing a positive, but detachable connection with adjacent ones of said individual floor panels, said adjacent ones of said individual floor panels being thereby connectable together by a shared one of said connecting strips; and connecting elements for connecting corner regions of directly adjacent ones of said individual floor panels, the connecting elements being located below said individual floor panels and including vertical disposed first legs, each one of said first legs engaging with a corresponding material gap in an undersurface of the lower layer of at least one of said directly adjacent ones of said individual floor panels.

2. The floor according to claim 1, wherein said lower layer is adhesively bonded to said upper layer.

3. The floor according to claim 1, wherein said lower layer is of lighter weight material than said upper layer.

4. The floor according to claim 1, wherein said upper layer is stone.

5. The floor according to claim 1, wherein said upper layer is glass.

6. The floor according to claim 5, wherein said glass has an underlying layer, bearing indicia, visible through said glass from above.

7. The floor according to claim 6, wherein said indicia is a graphic design.

8. A floor, comprising:

individual floor panels of multi-layer construction each comprising a pressure-resistant and wear-resistant upper layer and a pressure-resistant lower layer attached to said upper layer, said lower layer including horizontal grooves at vertical edges thereof;

connecting strips received in said grooves, for connecting adjacent ones of said individual floor panels, said connecting strips having horizontal legs with thickened portions thereon, said thickened portions being for clamping said connecting strips in said grooves;

sheathing, adhesively applied between said upper layer and said lower layer, and covering at least a part of a surface of a common interface between said upper layer and said lower layer, said sheathing having a higher modulus of elasticity and lower thickness than said upper layer; and connecting elements for connecting corner regions of directly adjacent ones of said individual floor panels. the connecting elements being located below said individual floor panels and including vertical disposed first legs, each one of said first legs engaging with a corresponding material gap in an undersurface of the lower layer of at least one of said directly adjacent ones of said individual floor panels.

9. The floor according to claim 8, wherein said sheathing covers an entire surface of said common interface between said upper layer and said lower layer.

10. The floor according to claim 8, wherein said sheathing is comprised of sheathing strips covering a part of said surface of said common interface between said upper layer and said lower layer.

11. The floor according to claim 8, wherein said sheathing comprises one selected from the group consisting of carbon-reinforced plastic, carbon-reinforced plastic fabric, fiberglass, and metal.

12. The floor according to claim 8, wherein said sheathing is contained within said lower layer.

13. The floor according to claim 10, wherein said lower layer contains corresponding sheathing slots for accommodating said sheathing strips.

14. A floor, comprising:

individual floor panels of multi-layer construction each comprising a pressure-resistant and wear-resistant upper layer and a pressure-resistant lower layer attached to said upper layer, said lower layer including horizontal grooves at vertical edges thereof;

fastening rails being fixed in said horizontal grooves, said fastening rails including horizontal reception grooves each which includes undercuts at upper and lower inner surfaces thereof;

connecting strips each including horizontal legs which are formed elastically by provision of a horizontal slot extending between a pair of leg segments which define each of said horizontal legs, said leg segments including thickened portions thereon which are vertically extended from a remainder of said leg segments in opposed directions, said thickened portions being configured to engage said undercuts at said upper and lower inner surfaces of the horizontal reception grooves of said fastening rails for providing a positive, but detachable connection with adjacent ones of said individual floor panels, said adjacent ones of said individual floor panels being thereby connectable together by a shared one of said connecting strips;

said individual floor panels each having a square shape with an edge length of 300 to 500 mm, and a thickness of 10 to 20 mm; and connecting elements for connecting corner regions of directly adjacent ones of said individual floor panels, the connecting elements being located below said individual floor panels and including vertical disposed first legs, each one of said first legs engaging with a corresponding material gap in an undersurface of the lower layer of at least one of said directly adjacent ones of said individual floor panels.

15. The floor according to claim 1, wherein:

said connecting strips each further comprises a vertical leg which includes at least a portion which extends upward from said horizontal legs; and an upper edge of said vertical leg terminates at or below an upper surface of said upper layer.

16. A floor, comprising:

individual floor panels of multi-layer construction each comprising a pressure-resistant and wear-resistant upper layer and a pressure-resistant lower layer attached to said upper layer, said lower layer including horizontal grooves at vertical edges thereof;

fastening rails being fixed in said horizontal grooves, said fastening rails including horizontal reception grooves each which includes undercuts at upper and lower inner surfaces thereof;

connecting strips each including horizontal legs which are formed elastically by provision of a horizontal slot extending between a pair of leg segments which define each of said horizontal legs, said leg segments including thickened portions thereon which are vertically extended from a remainder of said leg segments in opposed directions, said thickened portions being configured to engage said undercuts at said upper and lower inner surfaces of the horizontal reception grooves of said fastening rails for providing a positive, but detachable connection with adjacent ones of said individual floor panels, said adjacent ones of said individual floor panels being thereby connectable together by a shared one of said connecting strips, said connecting strips each including openings disposed between said horizontal legs through which water is dischargeable through said floor; and connecting elements for connecting corner regions of directly adjacent ones of said individual floor panels, the connecting elements being located below said individual floor panels and including vertical disposed first legs, each one of said first legs engaging with a corresponding material gap in an undersurface of the lower layer of at least one of said directly adjacent ones of said individual floor panels.

17. The floor according to claim 1, wherein:

said lower layer is comprised of a material lighter in weight than said upper layer; and said upper layer is thinner than said lower layer.

18. The floor according to claim 15, further comprising an edge strip comprised of an elastic plastic provided at an upper side of said vertical leg.

19. The multi-layer floor panel according to claim 1, wherein said second layer is comprised of a foamed material.

20. The multi-layer floor panel according to claim 1, further comprising sheathing interposed between said first and second layers, said sheathing being thinner than both said first and second layers and having a tensile strength and compression strength greater than that of the first layer.

21. The multi-layer floor panel according to claim 20, wherein said sheathing is comprised of sheathing strips accommodated in corresponding sheathing slots in said second layer.

22. The floor according to claim 1, wherein material grooves are each placed in the undersurface of the support members, whereas a material surface being enclosed by these material grooves corresponds with gaps placed in an area of the connecting elements.

23. The floor claim 22, wherein the outer legs are compressible into the material gaps of the support members and/or that material surfaces of support members being enclosed by material grooves are compressible into the gaps of the connecting element.

24. The floor according to claim 1, wherein vertical and right-angled joint fillets are fastened in a middle area of the connecting element, whereas the height of the joint fillets is smaller or equal to the thickness of the panels.

25. The floor according claim 24, wherein recesses are placed in vertical lateral faces of the support members corresponding to the joint fillets.

26. The floor according to claim 1, wherein the upper layer is wider and/or longer than the related support member, whereas the upper layer towers over the vertical lateral face of the support member.

27. The floor according to claim 1, wherein the undersurface of the support members features burling-like disposed material high spots.

28. The floor according to claim 1, wherein channel-like grooves are placed into the undersurface and/or into the upper surface of the support members.

29. The floor according to claim 1, wherein guide elements are placed at the floor panels and/or at the connecting element, via which joint strips can be fixed between the floor panels.

30. The floor according to claim 1, wherein each one of said first legs of said connecting elements is symmetrically placed and extends along a circular arc defined by a common arc length and a common radius, and wherein said corresponding material gaps have a corresponding shape and placement for engaging said first legs; and wherein each of said connecting elements further includes a plurality of vertical disposed joint fillets situated adjacent corresponding outer edge areas of said directly adjacent ones of said individual floor panels.

31. The floor according to claim 30, in which a first connecting element of said connecting elements connects corner regions of four directly adjacent ones of said individual floor panels and includes first legs engaging, respectively, with one or more of the material gaps among the four directly adjacent ones of said individual floor panels.

* * * * *